US005601021A

United States Patent [19]

Katabira et al.

[11] Patent Number: 5,601,021

[45] Date of Patent: Feb. 11, 1997

[54] PRINTING CYLINDER HOLDING APPARATUS FOR PRINTING MACHINE

[75] Inventors: Torao Katabira, Shizuoka-ken; Kazuyuki Baba, Tokyo, both of Japan

[73] Assignee: Toshiba Kikai Kabushiki Kaisha, Tokyo, Japan

[21] Appl. No.: 600,259

[22] Filed: Feb. 12, 1996

[30] Foreign Application Priority Data

Feb. 17, 1995 [JP] Japan ..... 7-029587

[51] Int. Cl.[6] ..... B41F 27/00

[52] U.S. Cl. ..... 101/218; 101/375

[58] Field of Search ..... 101/216, 217, 101/218, 247, 375

[56] References Cited

U.S. PATENT DOCUMENTS

| | | | |
|---|---|---|---|
| 4,119,032 | 10/1978 | Hollis | 101/216 |
| 4,807,527 | 2/1989 | Knauer | 101/216 |
| 4,823,693 | 4/1989 | Kobler | 101/375 |
| 5,101,726 | 4/1992 | Lubke et al. | 101/216 |
| 5,241,905 | 9/1993 | Guaraldi et al. | 101/216 |
| 5,458,061 | 10/1995 | Koura et al. | 101/216 |

FOREIGN PATENT DOCUMENTS

| | | |
|---|---|---|
| 6-191007 | 7/1994 | Japan . |
| 6-336004 | 12/1994 | Japan . |

*Primary Examiner*—Ren Yan

*Attorney, Agent, or Firm*—Finnegan, Henderson, Farabow, Garrett & Dunner, L.L.P.

[57] ABSTRACT

A printing cylinder holding apparatus for a printing machine, includes a pair of bearing holding members arranged on one of a pair of frames which rotatably support a printing cylinder via a pair of bearing members, respectively. One of the frames has a first opening for allowing a cylindrical printing member to be put on and out of the printing cylinder. The bearing holding members are movable between a holding position wherein the bearing holding members hold one of the bearing members and an unholding position wherein the bearing holding members release the one of the bearing members to form a second opening which is associated with the first opening for allowing the cylindrical printing member to be put in and out of the printing cylinder.

5 Claims, 4 Drawing Sheets

PRINTING CYLINDER HOLDING APPARATUS FOR PRINTING MACHINE

BACKGROUND OF THE INVENTION

1. Field of the Invention

The present invention relates generally to an apparatus for holding a printing cylinder for a printing machine. More specifically, the invention relates to a printing cylinder holding apparatus for a printing machine wherein a cylindrical printing member such as a cylindrical blanket of a blanket cylinder is detachably mounted on the outer periphery of a printing cylinder, the printing member being slidable on the outer periphery of the printing cylinder in axial directions to be put in and out thereof.

2. Description of the Related Art

Japanese Patent Laid-Open No. 6-336004 discloses a blanket cylinder as a printing cylinder for offset press. On the outer periphery of the blanket cylinder, a cylindrical blanket is detachably mounted. The cylindrical blanket is slidable on the outer periphery of the printing cylinder in axial directions to be put on and out thereof.

The blanket cylinder has a pair of shaft portions on both ends thereof. The shaft portions are rotatably supported on a pair of bearing members which are respectively mounted in a pair of frames arranged on both sides of the printing cylinder. In this printing cylinder supporting arrangement, it is required for one of the frames to have an opening for allowing the cylindrical blanket to be put on and out of the blanket cylinder, the both ends of which are supported on the frames.

FIG. 1 shows a conventional printing cylinder holding apparatus. A cylindrical blanket 3 is detachably mounted on the outer periphery of a blanket cylinder 1 so that the cylindrical blanket 3 is slidable on the outer periphery of the blanket cylinder 1 in the axial directions to be put on and out thereof. The cylindrical blanket 3 is provided with a pair of shaft portions 5 and 7 on both ends thereof. The shaft portions 5 and 7 are rotatably supported on right and left side frames 15 and 13 via bearing members 11 and 9, respectively.

The outer diameter of each of the shaft portions 5 and 7 is smaller than that of the blanket cylinder 1. The bearing member 9 for the shaft portion 5 is directly supported on the side frame 13. On the other hand, the bearing member 11 for the shaft portion 7 is supported on the side frame 15 via a sleeve 17 detachably mounted in an opening 19 which is formed in the side frame 15 for allowing the cylindrical blanket 3 to be put on and out of the blanket cylinder 1.

The outer diameter of the bearing member 11 is smaller than that of the blanket cylinder 1, and the inner diameter of the sleeve 17 is smaller than that of the blanket cylinder 1. The outer diameter of the sleeve 17 and the inner diameter of the opening 19 are greater than the outer diameter of the cylindrical blanket 3. The opening 19 is so formed that the its central axis coincide with the rotational axis of the blanket cylinder 1.

The sleeve 17 is provided with a handle 21 for manual operation. When the sleeve 17 is drawn out of the opening 19 by manually operating the handle 21, the opening 19 is open so that the cylindrical blanket 3 can be put on and out of the blanket cylinder 1 through the opening 19 in axial directions.

Japanese Patent Laid-Open No. 6-191007 discloses another type of a printing cylinder holding apparatus. This printing cylinder holding apparatus has a door assembly which is riseably mounted on a frame for opening and closing an opening. On this door assembly, a pair of half-shaped clamping members which are associated with each other for holding a bearing member are movably mounted.

In this printing cylinder holding apparatus, after the clamping members are moved at a loose position by means of a hydraulic cylinder to release the bearing member, when the door assembly is risen by means of another hydraulic cylinder to open the opening, then the cylindrical blanket can be put on and out of the blanket cylinder through the opening in axial directions.

In the conventional printing cylinder holding apparatus as shown in FIG. 1, when the sleeve 17 is intended to be put in the opening 19 again, the blanket cylinder 1 is supported on a single frame 13, so that the axis of the bearing member 11 is shifted from the center of the opening 19 so as to distort the annular space between the outer periphery of the bearing member 11 for the shaft potion 7 and the inner periphery of the opening 19. As a result, it is difficult to put the sleeve 17 in the distorted annular space. It is more difficult to do it when decreasing the gaps between the inner periphery of the sleeve 17 and the outer periphery of the bearing member 11 and between the outer periphery of the sleeve 17 and the inner periphery of the opening 19 in order to precisely support the blanket cylinder. Therefore, it is difficult to easily exchange the cylindrical blanket 3 while precisely supporting the blanket cylinder 1. In addition, it is required to secure a space in which the removed sleeve 17 is stored.

In the printing cylinder holding apparatus as shown in the Japanese Patent Laid-Open No. 6-191007, the clamping members are movably mounted on the door assembly. However, when the axis of the blanket cylinder is shifted from the central axis of the opening, it is difficult to smoothly hold the bearing member of the blanket cylinder again due to the fitting type holding structure of the bearing member.

In addition, this printing cylinder holding apparatus has a quadruplet structure comprising a door, clamping members, a bearing housing and a bearing member. Therefore, the structure is complicated, the door assembly is movable with respect to the frame, the clamping members are movable with respect to the door assembly, and gaps of at least several-hundredths millimeters are required between each movable members. Therefore, due to plays between the respective movable members, it is difficult to precisely support the blanket cylinder and to precisely rearrange the printing cylinder holding portion after the printing member is detached. It is also difficult to maintain the required accuracy for the printing cylinder holding apparatus, since shape error such as out-of-roundness of each members, dimensional error and assembly error are integrated to reduce the supporting and rearranging accuracy of the blanket cylinder.

SUMMARY OF THE INVENTION

It is therefore an object of the present invention to provide a printing cylinder holding apparatus for an offset press and so forth, which has a simple structure to easily exchange a cylindrical printing member such as a cylindrical blanket while precisely supporting a printing cylinder such as a blanket cylinder, which has a simple structure to precisely supporting the printing cylinder after the printing member has been detached, and which can move the printing cylinder to be an impression-throw-off position when the cylindrical printing member is exchanged or the like.

In order to accomplish the aforementioned and other objects, according to one aspect of the present invention, a printing cylinder holding apparatus for a printing machine, comprises: a substrate; a pair of frames mounted on the substrate and arranged on both sides of a printing cylinder which has a pair of shaft portions on both ends thereof; a pair of bearing members mounted on the frames for rotatably supporting the shaft portions thereon; a opening formed in one of the frames for allowing a cylindrical printing member to be put in and out of the printing cylinder; and a pair of bearing holding members arranged on the one of frames so as to face each other, the bearing holding members being movable between a holding position wherein the bearing holding members hold one of the bearing members and an unholding position wherein the bearing holding members release the one of the bearing members and form a opening for allowing the cylindrical printing member to be put in and out of the printing cylinder.

According to this printing cylinder holding apparatus, when the two bearing holding members facing each other move with respect to the frame from the holding position to the unholding position so as to be apart from another, the two bearing holding members release the bearing member and define therebetween the second opening for allowing the cylindrical printing member to be put in and out of the printing cylinder so that the second opening matches with the first opening formed in the frame. As a result, the matched openings allow the cylindrical printing member to be put in and out of the printing cylinder.

On the other hand, when the two bearing holding members move with respect to the frame from the unholding position to the holding position, the two bearing holding members hold the bearing member while holding the bearing member again so that its axis coincides with the right axis thereof.

The printing cylinder holding apparatus may include: an actuator for moving the bearing holding members between the holding position and the unholding position; and stopper means for mechanically setting the holding position of the bearing holding members. In this apparatus, the bearing holding members are driven between the holding position and the unholding position by means of the actuators, and the holding position of the bearing holding members is defined by stopper means such as abutting type stoppers.

The printing cylinder holding apparatus may have an extended shaft portion provided on one of the shaft portions of the printing cylinder on the side of the other frame to extend outside from the other frame, and a temporary supporting means for selectively temporary-supporting the extended shaft portion. In this apparatus, the extended shaft portion of the printing cylinder is selectively temporary-supported on temporary supporting means.

The bearing holding members may hold the shaft portions so that the central axis of one of the shaft portions coincide with that of the other shaft portion, the central axes of the shaft portions being apart from the common central axis of the bearing members, each of the bearing members being rotatably supported on the corresponding frames so as to allow the central axes of the shaft portions to be moved by rotation of the bearing members. In such a apparatus, when the bearing member rotates with respect to the frame, the central axis of the printing cylinder is displaced by its eccentric movement, so that the printing cylinder is moved to its impression-throwoff position.

The printing cylinder holding apparatus may also include: a driven gear secured to the one of the bearing members; a driving gear rotatably mounted on one of the bearing holding members for engaging the driven gear when the bearing holding members are positioned at the holding position; and a driving gear actuator connected to the driving gear for rotating the driving gear. In this apparatus, when the driven gear rotates by rotating the driving gear by means of the actuator when the bearing holding members are located at the holding position, the bearing member to which the driven gear is secured, rotates with respect to the frame.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENT

Figure 1:
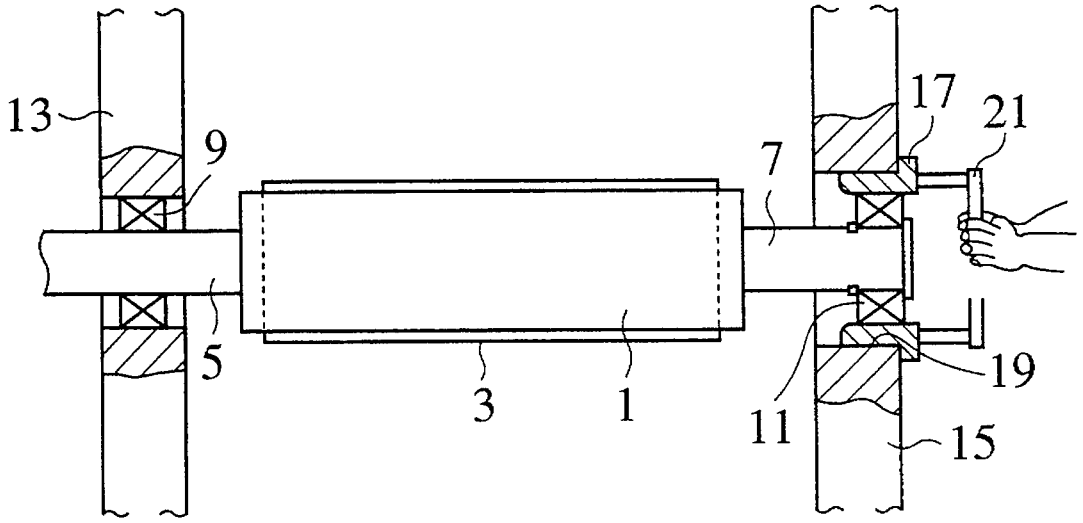
FIG.1 PRIOR ART
FIG. 1 is a plan view of a conventional printing cylinder holding apparatus for a printing machine.

Referring now to the accompanying drawings, particularly to FIGS. 2 to 6, there is shown the preferred embodiment of a printing cylinder holding apparatus for a printing machine, according to the present invention.

In this apparatus, right and left side frames 35 and 33 are arranged on a substrate 31 so as to face each other at regular intervals. Upper and lower blanket cylinders 37, 39 and upper and lower plate cylinder 41, 43 are rotatably and horizontally supported on the side frames 33 and 35 therebetween.

Cylindrical blankets 45 and 46 are detachably mounted on the outer periphery of each of the blanket cylinders 37 and 39 so as to be slidable thereon in axial directions to be put on and out thereof.

Both ends of the blanket cylinder 37 are provided with shaft portions 49 and 51 of a smaller diameter than the blanket cylinder 37. The shaft portions 49 and 51 are rotatably supported on the side frames 33 and 35 via bearing members 53 and 55.

The bearing member 53 is rotatably and displaceably mounted in a bearing mounting opening 57 formed in the side frame 33 so as to be directly supported on the side frame 33.

The side frame 35 has a blanket passing opening 59 for allowing the cylindrical blanket 45 to pass through the blanket passing opening 59 in axial directions and to be put on and out of the blanket cylinders 37 and 39. As can be clearly seen from FIGS. 3 and 4, guiding grooves 61 and 63 are formed on both sides of the blanket passing opening 59 so as to extend in horizontal directions. The guiding grooves 61 and 63 engage centripetal half-shaped bearing holding members 65 and 67 which are slidable in the guiding grooves 61 and 63 in horizontal directions.

Figure 3:
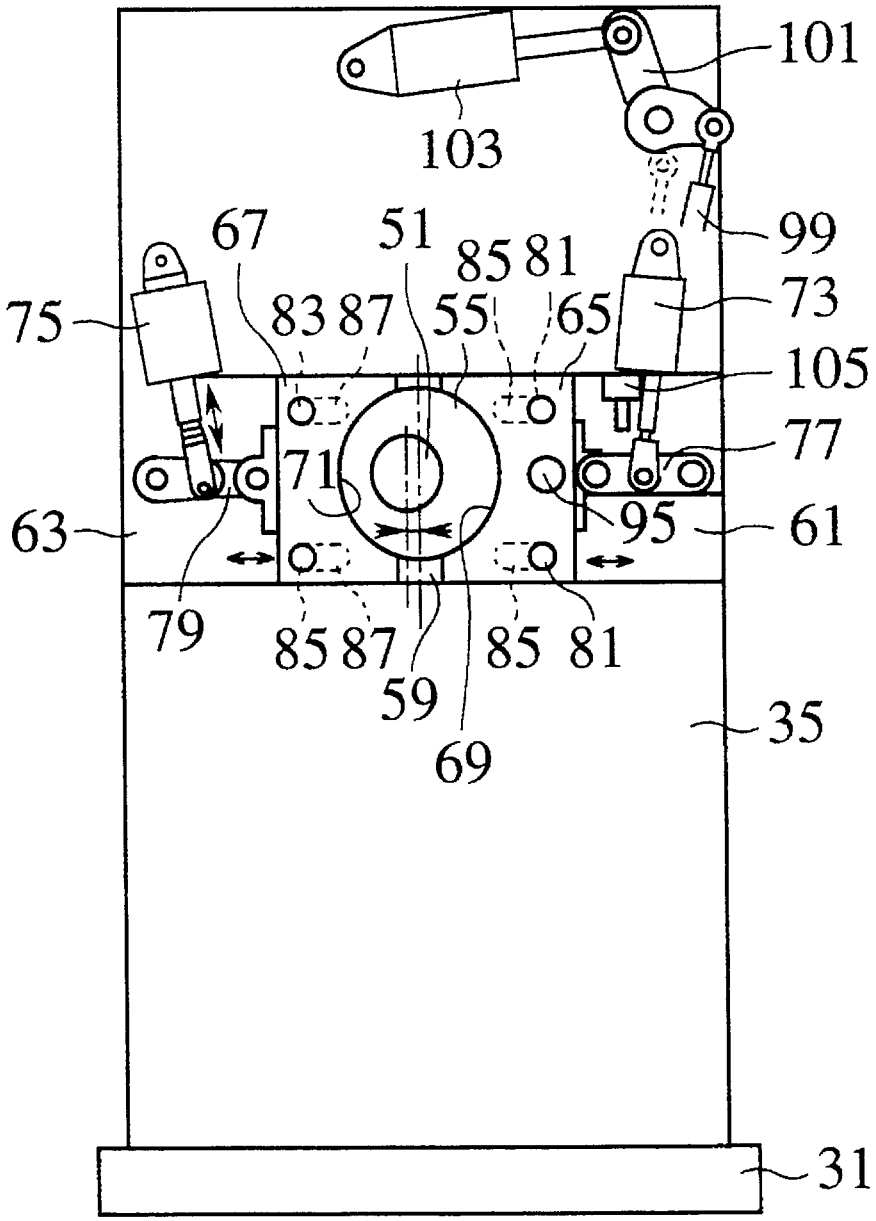
FIG. 3 is a side view of the preferred embodiment of a printing cylinder holding apparatus for a printing machine, according to the present invention.

The bearing holding members 65 and 67 are so arranged as to face each other and have semicircular bearing engaging portions 69 and 71 on the facing sides thereof. The inner diameter of each of the bearing engaging portions 69 and 71 has substantially the same as the outer diameter of the bearing member 53, so that the bearing member 55 is rotatably and displaceably supported on the bearing engaging portions 69 and 71. In a condition that the bearing member 55 is held by the bearing engaging portions 69 and 71 as shown in FIG. 3, the bearing engaging portions 69 and 71 forms a circle having the center which coincides with that of the bearing member 55 so as to cause automatically centripetal arrangement of the bearing member 55.

The bearing holding members 65 and 67 are respectively connected, via toggle links 77 and 79, to hydraulic cylinders 73 and 75 mounted on the side frame 33. By means of the hydraulic cylinders 73 and 75, the bearing holding members 65 and 67 are moved between a holding position wherein the bearing member 55 is clamped and held by the bearing holding members 65 and 67, and an unholding position wherein the holding members 65 and 67 are apart from another in a horizontal direction to release the bearing member 55 and to define therebetween an opening so as to match with the blanket passing opening 59 for allowing the cylindrical blanket 45 to pass in axial directions.

To the bottom of each of the guiding grooves 61 and 63, stopper pins 81 and 83 are secured. The bearing holding members 65 and 67 are formed with stopper engaging slots 85 and 87, each engaging the corresponding stopper pins 81 and 83. The aforementioned holding position of the bearing holding members 65 and 67 is mechanically set at a position where each of the stopper pins 81 and 83 contacts one end of the corresponding slots 85 and 87, and the aforementioned unholding position is mechanically set at a position where each of the stopper pins 81 and 83 contacts the other end of the corresponding slots 85 and 87.

The shaft portions 49 and 51 is eccentrically held by the bearing members 53 and 55, respectively, so that the common axis of the shaft portions 49 and 51 is shifted from the common axis of the bearing members 53 and 55. Therefore, when the bearing members 53 and 55 are rotated and displaced with respect to the side frames 33 and 35, the positions where the shaft portions 49 and 51 are held by the bearing members 53 and 55 are changed due to eccentric movement of the shaft portions 49 and 51 in accordance with eccentricity $\alpha$.

Figure 2:
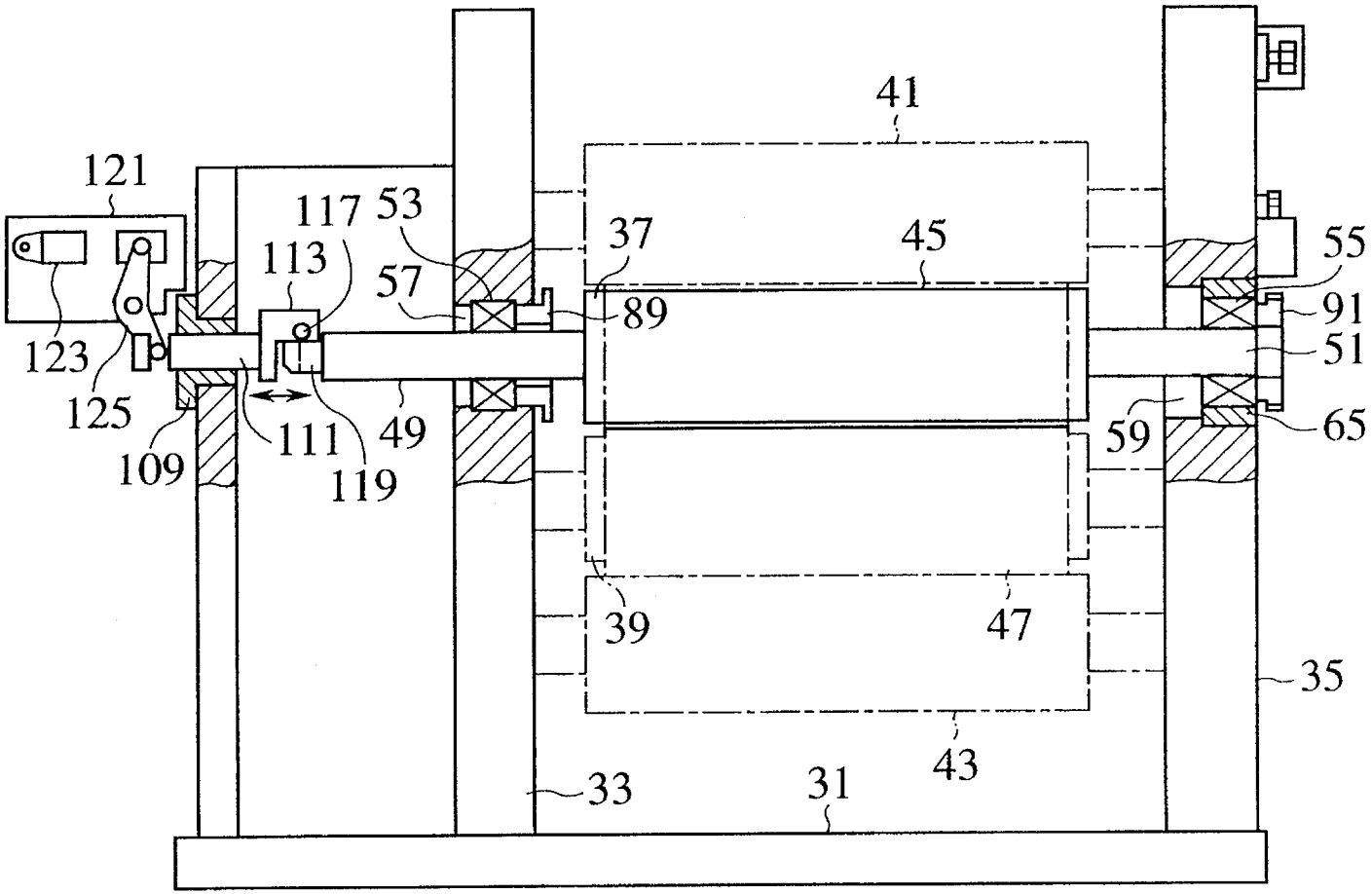
FIG. 2 is a front view of the preferred embodiment of a printing cylinder holding apparatus for a printing machine, according to the present invention.
Figure 4:
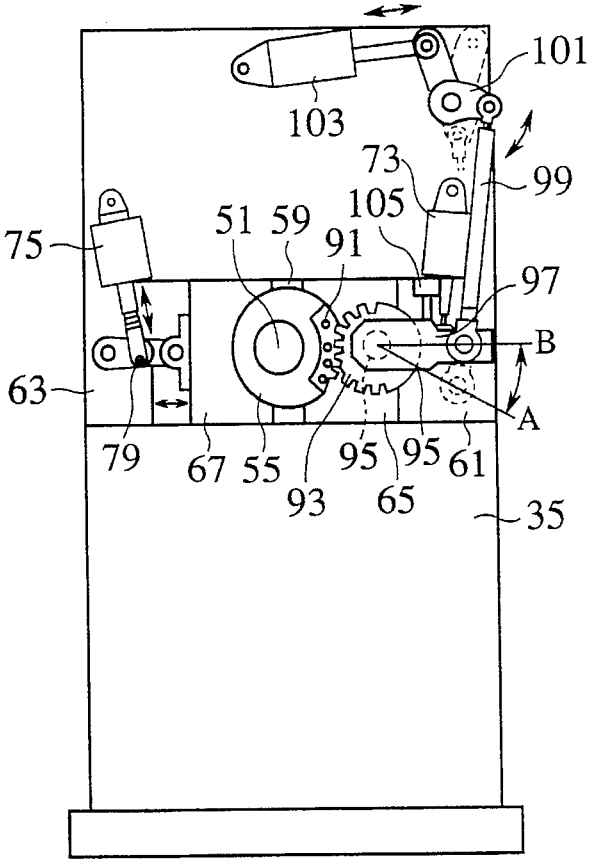
FIG. 4 is a side view of the preferred embodiment of a printing cylinder holding apparatus for a printing machine, according to the present invention, wherein its impression-throw-off mechanism is removed.
Figure 5:
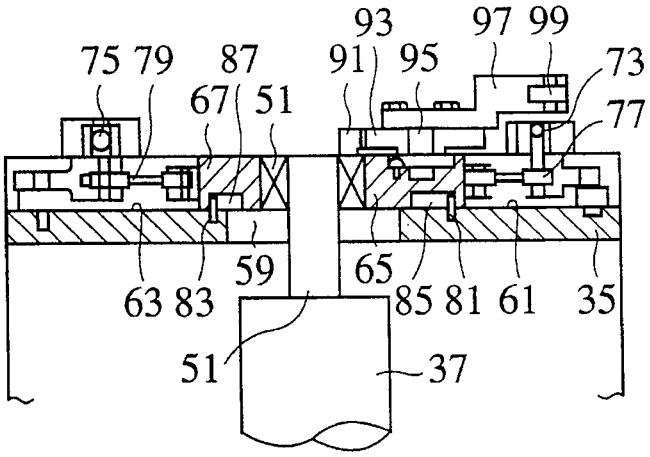
FIG. 5 is a sectional view showing an arrangement of bearing holding members in the preferred embodiment of a printing cylinder holding apparatus for a printing machine, according to the present invention.
Figure 6:
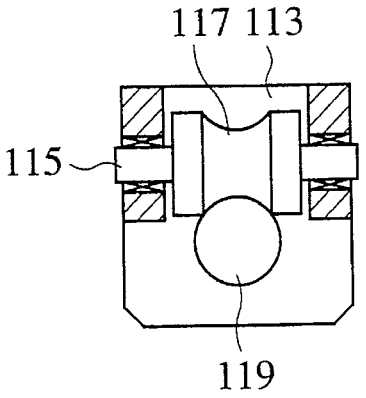
FIG. 6 is an enlarged view showing a temporary supporting arrangement in the preferred embodiment of a printing cylinder holding apparatus for a printing machine, according to the present invention.

As shown in FIG. 2, sector gears (driven gears) 89 and 91 are secured to the bearing members 53 and 55, respectively. As can be seen clearly from FIG. 4, a driving gear 93 which engages the sector gear 91 when the bearing holding member 65 is located at the holding position, is rotatably mounted on the bearing holding member 65 via a shaft 95. To the driving gear 93, a driving arm 97 is secured. The driving arm 97 is connected, via a connecting rod 99 and a lever 101, to a hydraulic cylinder 103 mounted on the side frame 35. The driving arm 97 is rotated and displaced between the positions A and B as shown in FIG. 4. The position B of the driving arm 94 is set at a position where the driving arm 97 contacts a stopper 105 secured to the side frame 35.

Furthermore, the outer diameters of the sector gear 91 and the bearing member 55 are smaller than that of the blanket cylinder 37 so as not to prevent the cylindrical blanket 45 from being put on and out of the blanket cylinder 37.

The sector gear 89 meshes with a gear (not shown) which is mounted on the side frame 33 and which is connected to the hydraulic cylinder 103 via a transmission mechanism (not shown) to be rotated in the same manner as that of the driving gear 93.

Outside the side frame 33, an outer frame 107 is mounted on the substrate 31. The outer frame 107 supports thereon a supporting shaft 111 via a bush 109, so as to allow the supporting shaft 111 to move in axial directions. On the tip of the supporting shaft 111, a bracket 113 is mounted. A temporary supporting roller 117 is rotatably supported on the bracket 113 via a shaft 115.

When the supporting shaft 111 moves forwards, i.e. to the right in FIG. 2, the temporary supporting roller 117 engages the upper surface of an extended shaft portion 119 provided on the tip of the shaft portion 49 which projects from the side frame 33 toward the outer frame 107, so as to run on the upper surface of the extended shaft 119.

By a mounting member 121, a hydraulic cylinder (actuator) 123 is mounted on the outer frame 107. The hydraulic cylinder 123 is designed to cause the reciprocating motion of the supporting shaft 111 in axial directions via a fork lever 125.

In a printing cylinder holding apparatus with the aforementioned construction, an operating process for putting the cylindrical blanket 45 on and out of the blanket cylinder 37 will be described below.

First, when the driving arm 97 is rotated from the position A to the position B by means of the hydraulic cylinder 103, the bearing member 55, together with the sector gear 91, is rotated and displaced by means of the driving gear 93, and the bearing member 53 is also rotated and displaced. As a result, the central axis of the blanket cylinder 37 is displaced, so that the blanket cylinder 37 is moved to an impression-throw-off position wherein the blanket cylinder 37 is apart from the plate cylinder 41 and the blanket cylinder 39.

Then, the supporting shaft 111 is moved forwards by means of the hydraulic cylinder 123, so that the temporary supporting roller 117 of the bracket 113 runs on and engages the upper surface of the extended shaft portion 119 as shown in FIG. 2.

Then, the toggle links 77 and 79 are driven by the hydraulic cylinders 73 and 75, so that the bearing holding members 65 and 67 are moved from the holding position to the unholding position in a horizontal direction.

As a result, the bearing holding members 65 and 67 are apart from another to release the bearing member 55, so that an opening is defined between the bearing holding members 65 and 67 so as to match with the blanket passing opening 59 of the side frame 35 for allowing the passage of the cylindrical blanket 45. Furthermore, since the driving gear 93 moves together with the bearing holding member 65 in the same direction, the driving gear 93 does not prevent the aforementioned opening from being formed.

In this condition, the cylindrical blanket 45 can be put on and out of the blanket cylinder 37 through the blanket passing opening 59 and the opening formed between the bearing holding members 65 and 67.

In this condition, the shaft portion 51 is not supported on the side frame 35. However, the blanket cylinder 37 is not only supported on the side frame 33 via the shaft portion 49 and the bearing member 53, but it is also supported on the outer frame 107 via the temporary supporting roller 117 which runs on the upper surface of the extended shaft portion 119 to engage therewith. By this two-point supporting arrangement, it is possible to restrain the right end of the axis of the blanket cylinder 37 from being lowered in FIG. 2. In addition, the two-point supporting arrangement can reduce the load applied to the bearing member 53 to extend the life time of the bearing member 53.

In order to hold the bearing member 55 again after removing the cylindrical blanket 45, the hydraulic cylinders 73 and 75 are driven in the inverse direction to move the bearing holding members 65 and 67 from the unholding position to the holding position. By these movements, the bearing holding members 65 and 67 are approached to another via the bearing member 55, so that the semicircular bearing engaging portions 69 and 71 hold the bearing member 55 while moving the bearing member 55 in the centripetal direction thereof.

The movements of the bearing holding members 65 and 67 to their holding positions are restrained due to the contact of each of the stopper pins 81 and 83 with one end of the corresponding stopper engaging slots 85 and 87. In this way, the holding positions of the bearing holding members 65 and 67 can be mechanically set in the same manner as a door stop. As a result, it is possible to set the holding positions of the bearing holding members 65 and 67 while removing plays of the movable portions such as the toggle links 77 and 79, and it is also possible to precisely reproduce the gap between the bearing engaging portions 69 and 71 and the bearing member 55. Therefore, it is possible to precisely maintain the supporting of the blanket cylinder 37 to improve quality of printing.

After the bearing member 55 has been held again by the bearing holding members 65 and 67, the hydraulic cylinder 123 is driven in the reverse direction to move the supporting shaft 111 rearwards so as to cause the temporary supporting roller 117 to be apart from the extended shaft portion 119. Then, the hydraulic cylinder 103 is driven in the reverse direction to rotate the driving arm 97 from the position B to the position A, so that the sector gear 91 and the bearing member 55 are rotated in the reverse directions, and the bearing member 53 is also rotated in the reverse direction. As a result, the central axis of the blanket cylinder 37 is displaced so that the blanket cylinder 37 returns the original cylinder putting position.

The aforementioned preferred embodiment of a printing cylinder holding apparatus according to the present invention is applied to only the blanket cylinder 37. However, a printing cylinder holding apparatus according to the present invention can be also applied to the blanket cylinder 39.

As can be understood from the aforementioned descriptions, in a printing cylinder holding apparatus according to the present invention, when two bearing holding members facing each other move from their holding portions to their unholding positions, the two shaft holding members are apart from another to release the bearing member and to form therebetween an opening which matches with a cylinder passing opening of a frame for allowing the passage of a cylindrical printing member such as a cylindrical blanket, so as to allow the cylindrical printing member to be put in and out of a printing cylinder. On the other hand, when the two bearing holding members move with respect to the frame from their unholding positions to the holding positions, the two bearing holding members hold the bearing member while moving the bearing member in the centripetal direction thereof. Therefore, with a simple construction, it is possible to easily exchange a cylindrical printing member such as a cylindrical blanket and to precisely support a printing cylinder such as a blanket cylinder. It is also possible to reduce the gap between the bearing holding member and the bearing member in the holding condition in comparison with the conventional apparatus, to reduce the vibrations of the printing cylinder when it is rotating.

In addition, the bearing holding members are driven by actuators between their holding positions and their unholding position, and the holding positions of the bearing holding members are defined by means of engagement type stoppers. Therefore, it is possible to automatically hold and release the bearing member without the need of any tools, and to precisely return the printing cylinder to the position at which the printing cylinder is to be supported.

Further, the extended shaft portion of the printing cylinder is selectively temporary-supported by temporary supporting means such as roller or the like provided on the blanket. Therefore, when the bearing member is released, the printing cylinder is supported on the frames via another bearing member so that two-point supporting arrangement is formed. Therefore, it is possible to improve supporting performance of the printing cylinder when the bearing member is released.

In addition, when the bearing member is rotated and displaced with respect to the frame, the central axis of the printing cylinder is displaced by its eccentric movement, so that the printing cylinder is moved to its impression-throwoff position. Therefore, it is possible to simply move the printing cylinder to the impression-throw-off position when the cylindrical printing member is exchanged.

Moreover, the rotation and displacement of the bearing member is performed by rotating a driving gear engaging a driven gear of the bearing member, by means of an actuator. Therefore, it is possible to simply perform the impression-throw-off operation without any manual operations, and the exchanging operation of the cylindrical printing member is not obstructed by such a driving mechanism.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A printing cylinder holding apparatus for a printing machine, comprising:

a substrate;

a pair of frames mounted on said substrate and arranged on both sides of a printing cylinder having a pair of shaft portions positioned at opposite ends of the printing cylinder, one of said pair of frames having an opening through which a cylindrical printing member mountable on the printing cylinder may be positioned on and removed from the printing cylinder;

a pair of bearing members mounted on said frames, respectively, for rotatably supporting the printing cylinder shaft portion thereon;

a pair of bearing holding members arranged on said frames so as to face each other, each of said bearing holding members being movable between a holding position at which said bearing holding members hold one of said bearing members and an unholding position at which said bearing holding members release said one of said bearing members to form an opening for allowing said cylindrical printing member to be positioned on and removed from the printing cylinder;

an actuator for moving said bearing holding members between said holding position and said unholding position; and stopper means for mechanically setting said holding position and said unholding position of said bearing holding members.

2. A printing cylinder holding apparatus as set forth in claim 1, wherein said stopper means comprises: at least one stopper pin projecting from at least one of said frames, and at least one elongated hole formed in at least one of said bearing holding members for engaging said stopper pin to set said holding position of at least one frame when said stopper pin is positioned at one end of said elongated hole and said unholding position when said stopper pin is positioned at the other end of said elongated hole.

3. A printing cylinder holding apparatus as set forth in claim 1, wherein the printing cylinder shaft portion opposite the one of said pair of frames with the opening has an extended printing cylinder shaft portion extending beyond the frame opposite the one of said pair of frames with the opening, and comprising a temporary supporting means for selectively temporary-supporting said extended printing cylinder shaft portion.

4. A printing cylinder holding apparatus as set forth in claim 1, wherein each of said printing cylinder shaft portion has a central axis and said bearing holding members hold said printing cylinder shaft portions so that the central axis of one of said printing cylinder shaft portions coincide with the central axis of the other printing cylinder shaft portion, said central axes of said printing cylinder shaft portions being spaced from the common central axis of said bearing members, each of said bearing members being rotatably supported on one of said frames so as to allow the central axes of said printing cylinder shaft portions to be moved by rotation of said bearing members.

5. A printing cylinder holding apparatus as set forth in claim 4, which further comprises:

a driven gear secured to said one of said bearing members;

a driving gear rotatably mounted on one of said bearing holding members for engaging said driven gear when said bearing holding members are positioned at said holding position; and a driving gear actuator connected to said driving gear for rotating said driving gear.

* * * * *